US010774531B2

(12) United States Patent
Galluccio

(10) Patent No.: US 10,774,531 B2
(45) Date of Patent: Sep. 15, 2020

(54) PANEL OF INSULATING MATERIAL WITH ATTACHED REINFORCEMENT

(71) Applicant: Anton Massimo Galluccio, Castellina in Chianti (IT)

(72) Inventor: Anton Massimo Galluccio, Castellina in Chianti (IT)

( * ) Notice: Subject to any disclaimer, the term of this patent is extended or adjusted under 35 U.S.C. 154(b) by 0 days.

(21) Appl. No.: 16/498,182

(22) PCT Filed: Mar. 28, 2018

(86) PCT No.: PCT/IT2018/050055
§ 371 (c)(1),
(2) Date: Sep. 26, 2019

(87) PCT Pub. No.: WO2018/179020
PCT Pub. Date: Oct. 4, 2018

(65) Prior Publication Data

US 2020/0040572 A1 Feb. 6, 2020

(30) Foreign Application Priority Data

Mar. 29, 2017 (IT) ..... 102017000034762

(51) Int. Cl.

| | |
|---|---|
| ***E04C 2/288*** | (2006.01) |
| ***E04B 2/84*** | (2006.01) |
| ***E04C 2/04*** | (2006.01) |
| ***E04C 5/16*** | (2006.01) |

(52) U.S. Cl.
CPC ..... *E04C 2/288* (2013.01); *E04B 2/84* (2013.01); *E04C 2/044* (2013.01); *E04C 5/166* (2013.01); *E04C 5/168* (2013.01); *E04C 2002/045* (2013.01)

(58) Field of Classification Search
CPC ..... E04C 2/288; E04C 2/044; E04C 5/166; E04C 5/168; E04C 2002/045; E04C 2002/047; E04C 2002/048; E04B 2/84; E04B 2/8647
See application file for complete search history.

(56) References Cited

U.S. PATENT DOCUMENTS 2,645,929 A * 7/1953 Jones ..... E04C 2/044 52/405.3
2,653,469 A * 9/1953 Callan ..... E04B 2/84 52/274
4,938,449 A * 7/1990 Boeshart ..... E04B 2/8647 249/216
6,202,375 B1 3/2001 Kleinschmidt
(Continued)

FOREIGN PATENT DOCUMENTS

DE 20 2012 010850 U1 7/2013
EP 0 591 849 A1 4/1994
(Continued)

*Primary Examiner* — Brian D Mattei
(74) *Attorney, Agent, or Firm* — McGlew and Tuttle, P.C.

(57) ABSTRACT

The reinforcing panel for reinforced concrete structures comprises a plurality of sticks (2) suitable for being arranged parallel to each other through a panel (12) of insulating material. The sticks (2), near the opposite ends (20), have a corresponding pair of slots (4, 5) protruding bilaterally in use from said panel (12) of insulating material. The slots (4, 5) are suitable for engaging and retaining reinforcing metal wires (6) on orthogonal planes.

14 Claims, 7 Drawing Sheets

(56) References Cited

U.S. PATENT DOCUMENTS

| | | | | |
|---|---|---|---|---|
| 6,279,285 | B1 * | 8/2001 | Kubica | E04G 11/10 249/191 |
| 9,074,379 | B2 * | 7/2015 | Ciuperca | E04G 9/10 |
| 2009/0173870 | A1 * | 7/2009 | Long, Sr. | E04G 11/18 249/16 |
| 2009/0218474 | A1 * | 9/2009 | Bowman | E04B 2/8611 249/18 |
| 2012/0180411 | A1 * | 7/2012 | Trimmer | E04B 1/16 52/220.1 |
| 2013/0074432 | A1 * | 3/2013 | Ciuperca | E04B 1/21 52/309.4 |

FOREIGN PATENT DOCUMENTS

| | | | |
|---|---|---|---|
| EP | 1 916 348 | A1 | 4/2008 |
| WO | 2016/005917 | A1 | 1/2016 |

* cited by examiner

3

2
4
7
20

5

M

PANEL OF INSULATING MATERIAL WITH ATTACHED REINFORCEMENT

TECHNICAL FIELD

The present invention relates to a reinforcing panel for the construction of reinforced concrete structures and a method for producing such a panel.

BACKGROUND ART

In the field of civil construction, the use of prefabricated reinforcing panels to make walls, floors and other similar reinforced concrete structures is known. These panels generally consist of a slab of expanded material, e.g. a polystyrene one, sandwiched between a pair of metal mesh sheets; the metal mesh sheets are usually made of electrowelded steel wires. Reinforcing panels are made in the form of modular elements to be assembled on site. In particular, the panels are designed to be integrated on site with concrete casting so as to make load-bearing structural elements made of reinforced concrete.

Patent EP 0 591 849 illustrates, for example, a panel for the construction of walls or floors consisting of a slab of expanded material, provided with thermal and acoustic insulation features, clamped between two metal mesh sheets which are mutually connected by transverse elements passing through the slab of insulating material. The slab of insulating material has parallel corrugations on the opposite faces and is crossed, on a middle plane, by a cavity wherein a metal cage is housed as a reinforcement.

To produce the aforesaid reinforcing panels, the assembly of the slabs of expanded material to the metal mesh sheets, on a welding bench, is usually carried out using transverse connection segments made of, in turn, steel wires. These transverse wires are pushed or guided through the slabs of expanded material and then are cut to size and welded at their ends to the metal meshes.

The assembly operations of the slabs of expanded material to the metal mesh sheets and the welding of the wires transversal to the aforesaid sheets are carried out using suitable equipment. The equipment used for this purpose is generally both structurally and functionally complex, and requires a wide operating space.

In addition, it is often claimed that the production of reinforcing panels is laborious and not easy to implement. It should be noted that the slab of expanded material and the metal mesh sheets must be properly aligned to form the required sandwich structure.

A further drawback that has been criticized in the relevant field is the fact that the transport of the traditional reinforcing panels to the installation area is not easy due to their size, notwithstanding their low weight, resulting in a manifest increase in building costs.

To overcome these drawbacks, patent application WO 2016/005917 proposed the use of a reinforcing panel comprising a honeycomb structure formed by a plurality of sticks obtained from a strip of band material, mutually associated on orthogonal geometric planes and shaping bilaterally an ordered series of first and second hooking means, protruding from the same honeycomb structure to engage and retain reinforcing metal wires.

Nevertheless, the production of the reinforcing panels thus designed has proved to be laborious, especially as regards the preparation of the aforementioned honeycomb structure.

DISCLOSURE

The aim of the present invention is to solve the aforementioned problems, by devising a reinforcing panel which allows the construction of reinforced concrete structures to be carried out quickly and easily, as well as a method for producing such reinforcing panels.

Within this aim, it is a further object of the present invention to provide a reinforcing panel which can be easily produced without the use of complex equipment.

Another object of the invention is to provide a reinforcing panel which allows to optimize production and installation costs.

A further object of the invention is to provide a reinforcing panel of simple constructional and functional conception, absolutely reliable in functioning, versatile in use and relatively cheap.

The aforementioned objects are achieved, according to the present invention, by the reinforcing panel for reinforced concrete structures according to claim 1.

The reinforcing panel for reinforced concrete structures includes a panel of insulating material; a plurality of inserted sticks passing through said panel of insulating material so as to protrude at opposite ends from the same panel of insulating material; a plurality of reinforcing metal wires associated bilaterally with said sticks at said opposite ends so as to provide, on each side of said panel of insulating material, a network structure lying respectively on a plane parallel to said panel of insulating material.

Advantageously, said metal wires are associated with said sticks in correspondence of slots formed on said opposite ends of the sticks.

Advantageously, said sticks are right-angularly bent longitudinally along the medial axis, so as to define two wings perpendicular to each other, and have at each end a pair of said slots formed at said perpendicular wings, respectively.

Preferably, said slots forming each pair of slots are offset from each other in longitudinal direction with respect to said sticks, so as to arrange said metal wires associated thereto in perpendicular directions.

Preferably, said slots have a substantially circular shape substantially corresponding to the profile of said metal wires.

Preferably, said slots are open laterally at the edges of said perpendicular wings of the sticks.

Preferably said sticks are obtained from a strip of metallic material.

Preferably, said sticks have at least one opening in a central area suitable for facilitating the anchoring of the sticks themselves into said panel of insulating material.

The present invention also relates to a method for producing reinforcing panels, especially for the construction of reinforced concrete structures, which provides for the association of a plurality of sticks protruding at opposite ends from the same panel with a panel of insulating material, said sticks having bilaterally a plurality of reinforcing metal wires in correspondence of said opposite ends so as to provide, on each side of said panel of insulating material, a network structure lying on a plane parallel to said panel of insulating material, respectively.

Advantageously, the method provides for the arrangement of said sticks on a mould suitable for producing said panel of insulating material.

Advantageously, the method provides for the association of said sticks with a pair of opposed front walls of said mould, so as to protrude bilaterally at said opposite ends from the compartment defined by those front walls of said panel of insulating material.

Advantageously, said sticks are associated with said mould so as to be aligned with each other according to a series of rows and regularly spaced columns, along which said metal reinforcing wires are used so as to form said network structure.

Preferably, said front walls of the mould have through holes having calibrated dimensions for the through insertion of said sticks.

Preferably, the method provides for the introduction of said insulating material into said mould in the form of foam.

Advantageously, said sticks are inserted through said front walls of the mould using a feeding device equipped with a pusher member.

Preferably, said feeding device comprises a removable guide suitable for steering the insertion of the individual sticks through the said front walls of the mould.

Preferably, the guide is provided with adhesion means suitable for ensuring the adhesion of the individual sticks to the guide itself.

According to an embodiment of the method under consideration, protecting means suitable for ensuring adequate thermal insulation shall be inserted at the ends of said sticks protruding from at least one face of said panel of insulating material.

Preferably, said protection means have a shape which combine with said ends of said sticks.

Finally, the method under consideration provides for the casting of concrete at said opposite faces of the panel of insulating material for producing said reinforced concrete structure.

According to an embodiment of the method under consideration, it is provided that said mould is internally coated by a shell, before introducing said insulating material in the form of foam into said mould.

The insertion of said shell into the mould compartment facilitates the extraction of the panel of insulating material.

DESCRIPTION OF THE DRAWINGS

The details of the invention will become more evident from the detailed description of a preferred embodiment of the reinforcing panel for reinforced concrete structures, illustrated by way of example in the accompanying drawings, wherein.

BEST MODE

Figure 1:
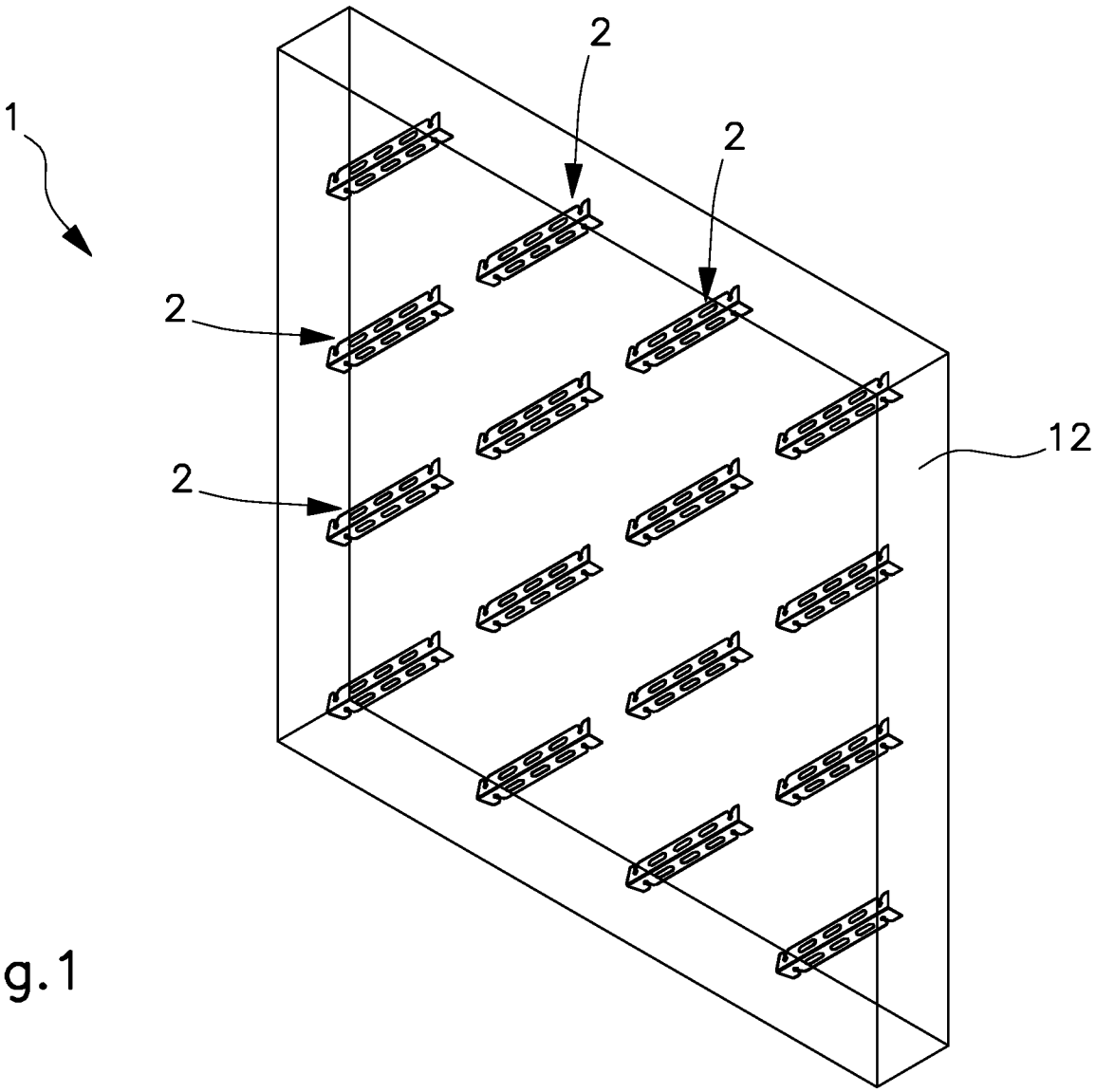
FIG. 1 is a perspective schematic view of a reinforcing panel according to the present invention.
Figure 2:
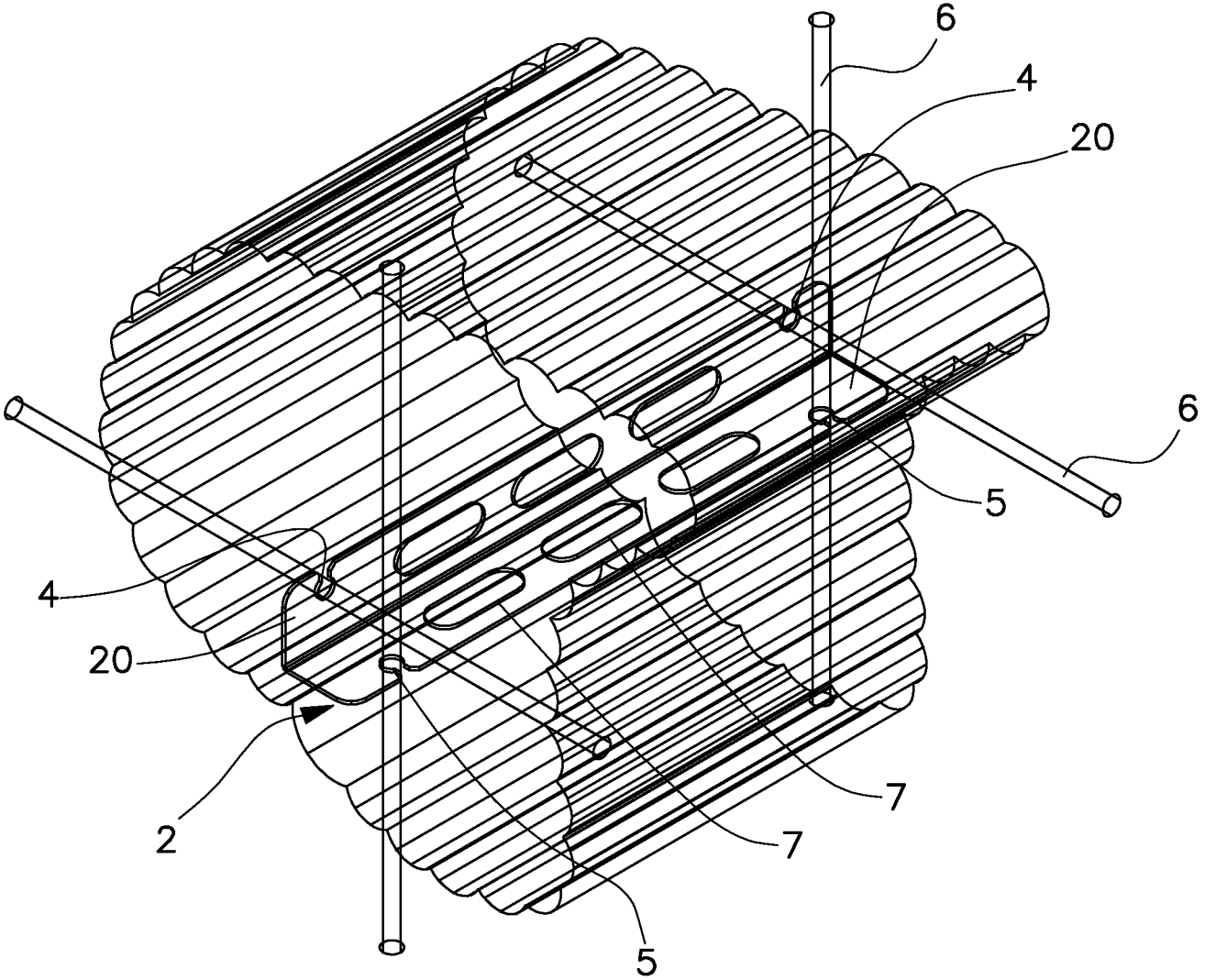
FIGS. 2 and 3 show respective views of an enlarged area of the reinforcing panel under consideration.
Figure 3:
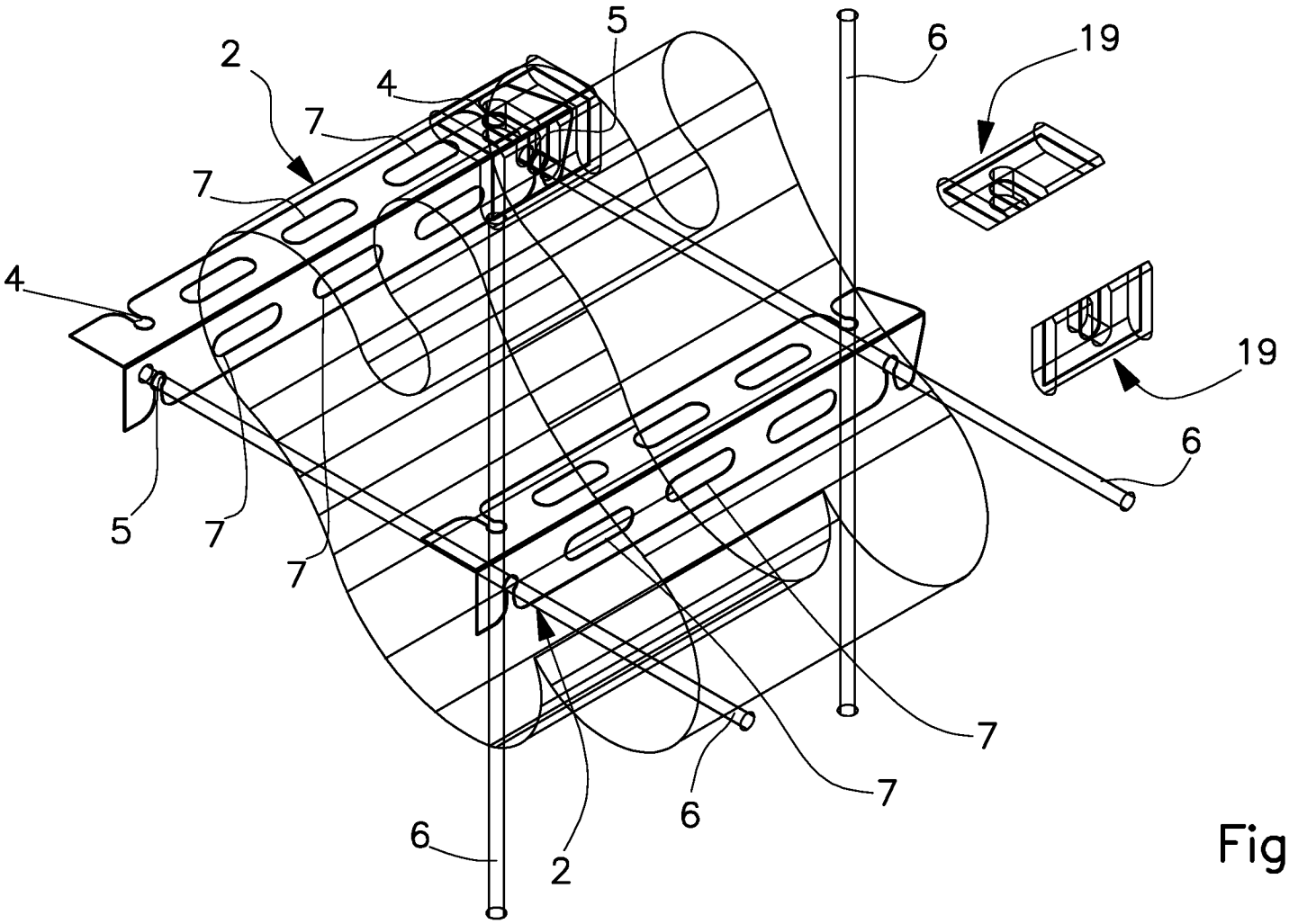

With particular reference to these figures, the whole reinforcing panel for the construction of reinforced concrete structures object of the invention is referred to as 1.

The reinforcing panel 1 comprises a panel 12 of insulating material with which a plurality of sticks 2 regularly arranged on parallel and orthogonal planes to form a sort of network is associated.

The sticks 2 are obtained from a strip 3 of metallic material, preferably in the form of a band; alternatively, the sticks 2 can be obtained by moulding plastics, e.g. by thermoforming strips made of plastics. Preferably, the strip 3 of metallic material is made of steel.

The strip 3 is bent longitudinally, along the medial axis M, so as to define two wings perpendicular to each other.

Near their ends 20, the sticks 2 are provided with corresponding pairs of slots 4, 5 opposed and offset from each other in a longitudinal direction with respect to the sticks 2 themselves. The slots 4, 5, by means of appropriate cutting operations, are provided in a circular shape and are open laterally along the edges of the sticks 2. The slots 4, 5 are designed to engage and retain metal reinforcing wires 6, as better specified below.

It should be noted that, at each end 20 of the sticks 2, the slots 4, 5 are formed on both the orthogonal wings of the same sticks 2, respectively. Therefore, the slots 4, 5 are, in turn, arranged on orthogonal planes.

The ends 20 of the sticks 2 have rounded edges to facilitate the association of the sticks 2 with a mould, as specified below, as well as to increase the safety in use.

Preferably, the sticks 2 also have at least one opening 7 formed in a middle position between the pairs of slots 4, 5. Preferably, the sticks 2 have a series of openings 7 suitably spaced apart from one another.

In the illustrated embodiment, the openings 7 are regularly spaced apart along the longitudinal direction and aligned in substantially parallel rows. In addition to reducing the weight of the individual sticks 2, the openings 7 serve the purpose of optimizing the anchoring of the sticks 2 to the insulating material.

The method for producing reinforcing panels according to the present invention is described below.

First of all, the sticks 2 shall be provided, in the necessary amount, starting from strips 3 of metallic material, preferably in the form of bands, e.g. made of steel of a suitable thickness or of plastics. The thickness of the strips 3 is preferably less than or equal to 0.5 mm.

Each strip 3 of metallic material is suitably shaped by shaping means such as, for example, punching members suitable for operating on slots 4, 5 on opposite sides of the strip 3.

The slots 4, 5 are offset in the longitudinal direction and, in particular, the distance between the opposed slots is substantially equal to the cross-section of the reinforcing wires 6.

In the middle position with respect to the pairs of slots 4, 5 the shaping means make the openings 7.

The shaped strip 3 of metallic material is subsequently cut to size into a plurality of sticks 2 with predetermined size.

Figures 4, 5, 6, 7:
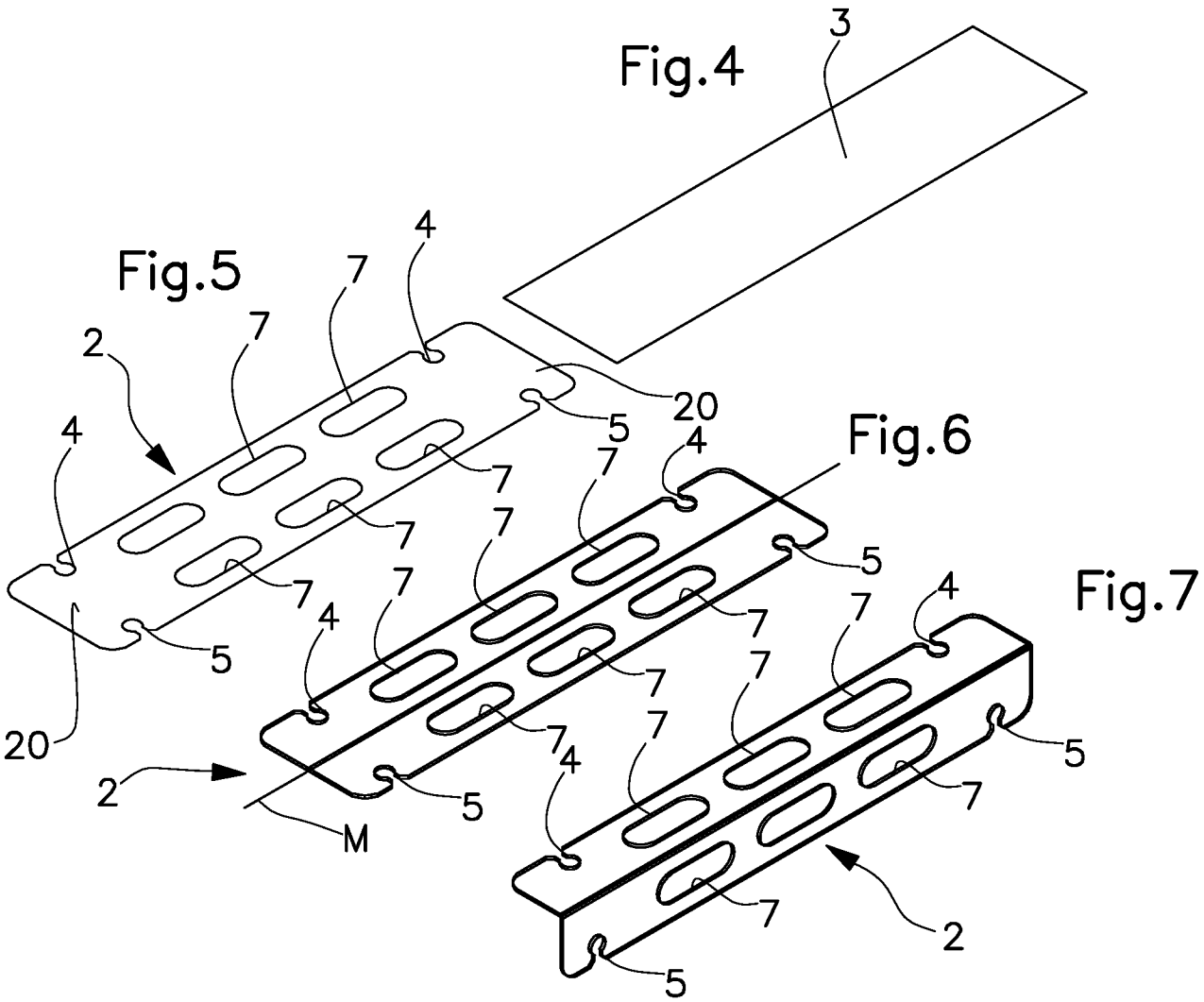
FIGS. 4, 5, 6 and 7 show the next steps for the production of sticks used for producing the reinforcing panel.
Figure 8:
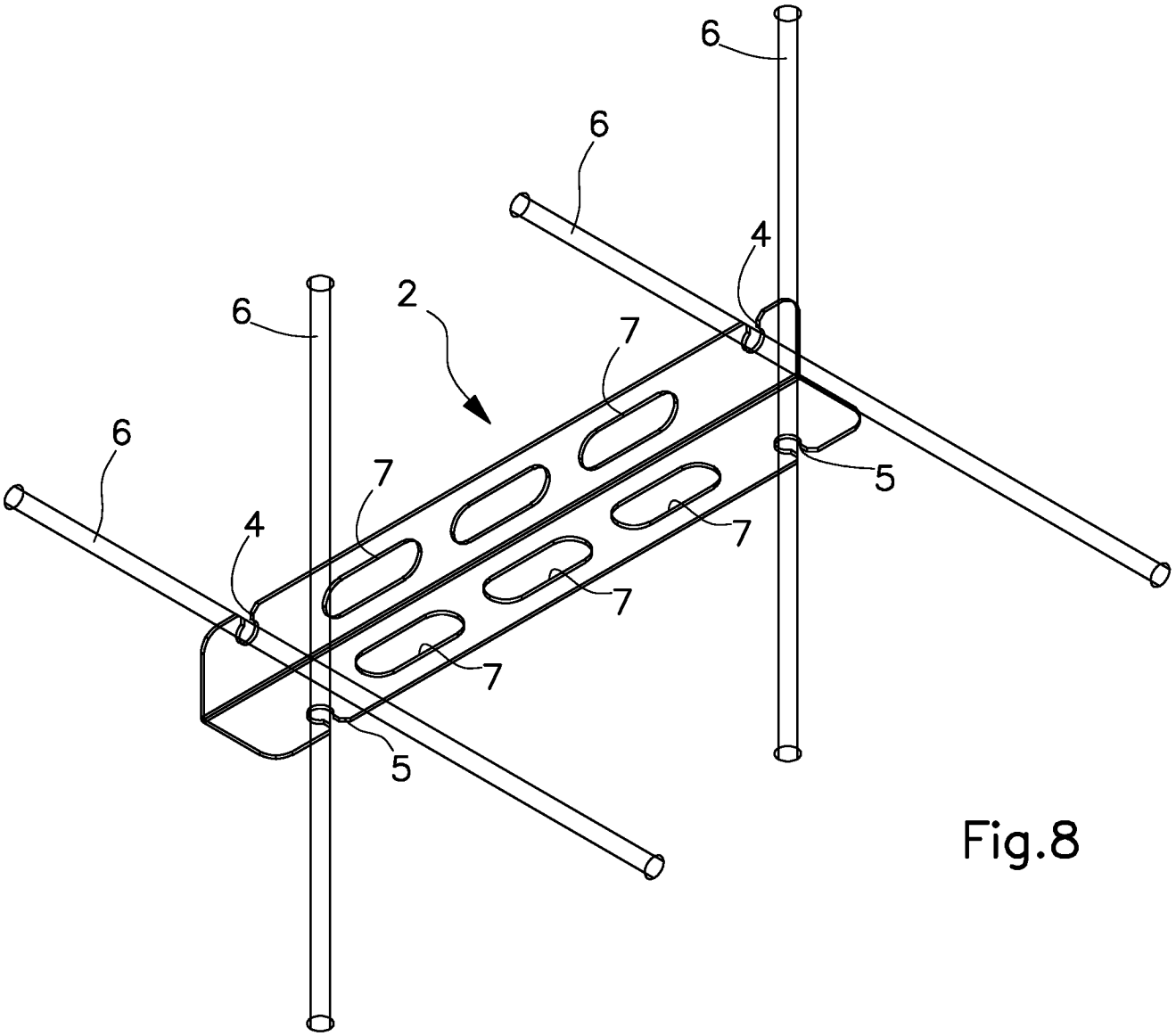
FIG. 8 shows a view of a stick associated with metal reinforcing wires.

The sticks 2 are bent longitudinally to arrange the pairs of slots 4, 5 on orthogonal planes (see FIG. 7).

In order to produce the reinforcing panels, a mould 8 is prepared consisting substantially of a case comprising a pair of opposed front walls 9 connected by perimeter connection means 10 suitable for spacing apart the walls 9 properly during the production of the panel 1.

The perimeter connection means 10 and the opposed front walls 9 define a compartment 11 suitable for being filled with a suitable insulating material to obtain a panel 12 of insulating material. Preferably, the insulating material is in the form of foam.

Said perimeter connection means 10 have a substantially C-shaped profile. In particular, the connection means 10 comprise a pair of side walls 13 and, at their top, a cover 14, giving the mould 8, together with the opposed front walls 9, the shape of a parallelepiped.

The cover 14 is movable, e.g. slidable along suitable guides, not shown, to allow insertion of the insulating material into the compartment 11.

When an insulating material in the form of foam is used, the side walls 13 and the cover 14, in addition to holding the opposed front walls 9 at a predetermined distance, also serve the purpose of preventing the expansion of the material outside the compartment 11.

The side walls 13 are moved by actuator means, not seen in figures, so as to allow the decoupling of the front walls 9 after the formation of the panel 12 of insulating material.

According to a preferred embodiment, one of the walls 9 is fixed and the opposed wall is movable, suitable for being moved away from the fixed wall after the insertion of the insulating material.

On the surface of the front walls 9 a series of through holes 15, regularly arranged, is formed to allow insertion of the sticks 2 through the walls 9 and to function as housings for the portions of the sticks 2 which have the slots 4, 5. The holes 15 of a front wall 9 are aligned with the corresponding holes 15 of the opposed front wall 9.

The size of the holes is calibrated as a function of the size of the sticks 2 to be inserted and in such a way to avoid the leakage of the insulating material from the mould 8.

According to the aforesaid embodiment, the holes 15 formed on the fixed front wall 9 have a larger diameter than the holes 15 formed on the movable front wall 9, since they are designed to let the sticks 2 pass together with a suitable feeding device 16.

Once the mould 8 has been prepared, the sticks 2 are associated with the pair of walls 9 so that the slots 4, 5, respectively, thus protrude bilaterally with respect to the inner compartment 11.

Figure 9:
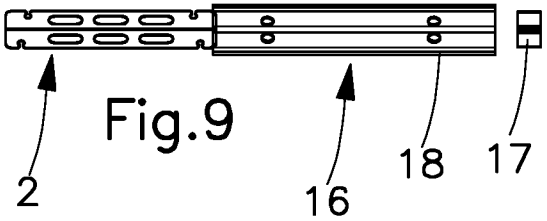
FIG. 9 shows a side view of a device for feeding said sticks into a mould designed to produce the reinforcing panel under consideration.

More precisely, to facilitate insertion, a plurality of sticks 2 are fed onto feeding devices 16 equipped with suitable pusher members 17 (see FIG. 9). In particular, feeding devices 16 are provided at the holes 15 of a front wall 9, respectively. The sticks 2 are pushed individually by the pusher members 17 through the respective holes 15 of a front wall 9 and guided by the respective feeding devices 16 until they are inserted into the corresponding holes 15 of the opposed front wall 9.

Each feeding device 16 comprises a guide 18, for example a telescopic one, which can be extracted from the device 16 so as to steer the insertion of the individual sticks 2 through the front walls 9 of the mould 8. The guide 18 is provided with adhesion means, not seen in figures, suitable for ensuring the adhesion of the individual sticks 2 to the guide 18 itself. Such adhesion means can be, for example, when sticks 2 are made of metallic material, magnetic means.

The step of pushing individually the sticks 2 by the pusher members 17 through the respective holes 15 of a front wall 9 and guiding them until they are inserted into the corresponding holes 15 of the opposed front wall 9 provides, in particular, for the extraction of the relative guides 18 from the feeding devices 16 until they are abutted against the opposed wall 9 and, subsequently, for actuating the pusher members 17 in order to make the sticks 2 slide on the respective guides 18 until they are inserted into the opposed holes 15. Preferably, the pusher members 17 related to a row or a column of sticks 2 to be inserted through the mould 8 shall be actuated synchronously.

Figure 10:
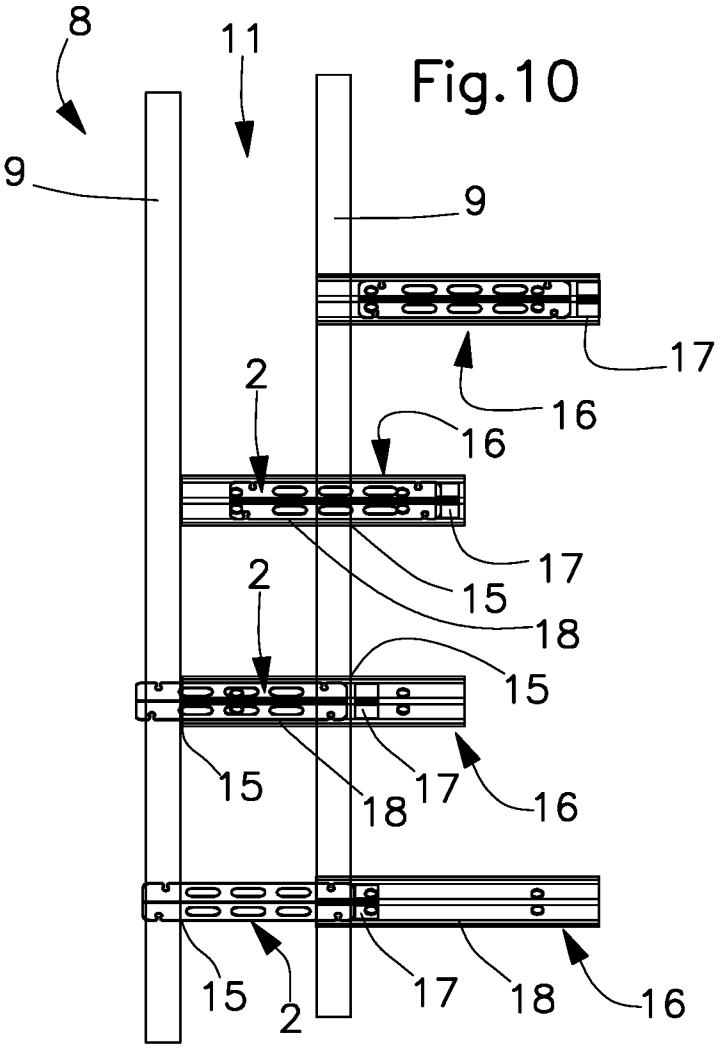
FIG. 10 shows a cross-sectional view of said mould wherein the next steps for the insertion of said sticks are shown.
Figure 11:
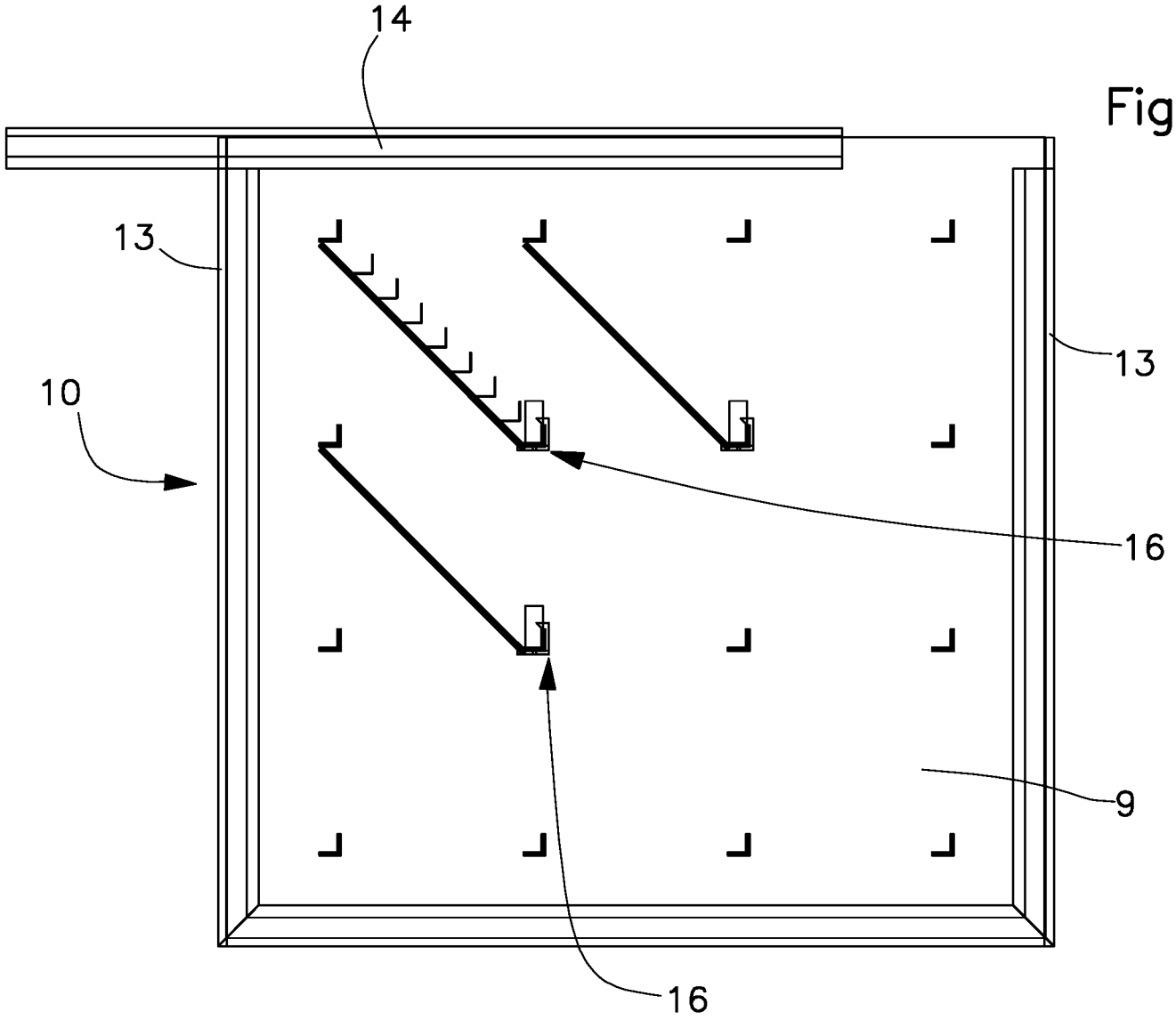
FIG. 11 shows a schematic front view of the mould provided with a series of feeding devices.

Once the sticks 2 have been inserted through the holes 15 with the slots 4, 5 protruding bilaterally from the inner compartment 11, the guides 18 shall be withdrawn, while the pusher members 17 are held in contact with the respective sticks 2 so that they can keep on exerting respective thrust forces on the sticks 2 to counteract the force exerted by the adhesion means of the guides 18, thus avoiding the removal of the sticks 2 from the holes 15 (see FIG. 10).

The individual sticks 2 associated with the mould 8 have slots 4, 5 in the housings defined by the holes 15 of the facing front walls 9 and the middle portion provided with the openings 7 in the inner compartment 11.

The next step provides for the insertion into the compartment 11 of an insulating material, in particular in the form of foam, to obtain a panel 12 of insulating material. It should be noted that the insulating material fills the openings 7 facilitating the adhesion of the sticks 2 to the material itself, and thus making the structure of the panel 1 more stable.

After the hardening of the insulating material in the form of foam, at least one wall 9 of the mould 8 shall be moved to extract the panel 12 of insulating material from the mould 8. Then, a series of reinforcing metal wires 6 are connected to the slots 4, 5 of the sticks 2 protruding from the layer of insulating material to form a network. The offset arrangement of the slots 4, 5 of each pair allows to arrange the orthogonal metal wires 6 on planes which are separate from one another, so as to avoid interference between the metal wires 3 themselves. A metal mesh is thus created wherein the metal wires 6 are not welded.

The reinforcing panels thus produced are then joined together modularly, as per design.

It is possible to insert at the ends 20 of the sticks 2 protruding from at least one face of the panel of insulating material 12 protection means 19 having a shape combined with the aforesaid ends 20, suitable for ensuring adequate thermal insulation.

The concrete shall then be cast at the opposite sides of the panel itself, according to the relevant known art, in order to produce the reinforced concrete structure, e.g. a wall or a floor. Metal wires 6 are thus embedded in the concrete.

An alternative embodiment of the method for producing reinforcing panels according to the present invention is described below.

A plurality of sticks 2, in the necessary amount, having the characteristics described above shall be provided.

It is then provided the mould 8 having a pair of opposed front walls 9 connected by the perimeter connection means 10 for suitably spacing the walls 9.

The next step provides for the coating of the opposed front walls 9, the side walls 13, and the cover 14 which define the compartment 11, in particular the face of the walls 9, 13, 14 facing the inside of the mould 8, with a removable shell, not seen in figures, so as to prevent the insulating material to be inserted into the compartment 11 from adhering to the aforesaid walls 9, 13, 14.

The shell can be made, for example, of plastic material or of a suitable type of paper material.

The next step provides for the insertion into the compartment 11 of an insulating material, in particular in the form of foam, to obtain a panel 12 of insulating material. It should be noted that the shell prevents the insulating material from coming out of the holes 15 of the opposed walls 9.

Following the hardening of the insulating material in the form of foam, the sticks 2 are then associated with the pair of front walls 9, inserting them in the opposed holes 15 through the panel 12 of insulating material, so that the respective slots 4, 5, respectively, thus protrude bilaterally with respect to the insulating material. This step provides for the use of the feeding devices 16 and the respective pusher members 17 as described above.

Then, at least one wall 9 of the mould 8 shall be moved to extract the panel of insulating material 12 from the mould 8. An advantageous aspect of this method is that the shell considerably facilitates the extraction of the panel of insulating material 12.

Then, a series of reinforcing metal wires 6 are connected to the slots 4, 5 of the sticks 2 protruding from the panel 12 of insulating material to form a network. The offset arrangement of the slots 4, 5 of each pair allows to arrange the orthogonal metal wires 6 on planes which are separate from one another, so as to avoid interference between the metal wires 6 themselves.

The reinforcing panels thus produced are then joined together modularly, as per design.

It is possible, here too, to insert at the ends 20 of the sticks 2 protruding from at least one face of the panel of insulating material protection means 19 having a shape combined with the aforesaid ends 20, suitable for ensuring adequate thermal insulation.

The concrete shall then be cast at the opposite sides of the panel itself, according to the relevant known art, in order to produce the reinforced concrete structure, e.g. a wall or a floor. Metal wires 6 are thus embedded in the concrete.

The described method achieves the object of carrying out easily and quickly the production of reinforcing panels for the construction of reinforced concrete structures.

Indeed, to produce reinforcing panels is not necessary to turn to complex and bulky devices, but it is sufficient to produce sticks suitably bent to arrange the slots on planes orthogonal to each other and to associate them with the mould. The insertion of the sticks into the mould is facilitated by the use of the feeding devices which make the positioning operation of the sticks quick and accurate. Moreover, the hooking of the metal wires to the panel such as to form substantially a metal mesh on the two opposite sides of the panel is obtained by inserting the metal wires into the slots, without requiring welding operations and the like.

A prerogative of the method for producing reinforcing panels for the construction of reinforced concrete structures according to the present invention, as well as of the reinforcing panel thus produced, consists in that they can be made on site, i.e. at the construction site of the reinforced concrete structure. Therefore, it is sufficient to have the proper amount of shaped sticks, as well as the mould and the feeding devices. This avoids issues related to on-site transport of large-sized items, since the described sticks may be obviously collected in compact groups of very limited size. Furthermore, the use of insulating material in the form of foam capable of expanding after being inserted into the inner compartment of the mould further facilitates the on-site transport, since the material of this type is generally stored in containers with reduced size.

The production of the panel on site obviously leads to a significant reduction in construction costs, both because of the ease of production of reinforcing panels, which does not require the use of complex equipment, and because of the reduced transport costs.

In the practical embodiment of the invention, the materials used, as well as shape and dimensions, may be any according to requirements.

Where the technical features mentioned in any of the claims are followed by reference numerals, these reference numerals are included to improve the comprehension of the claims only, and consequently they have no limiting effect on the object of each element identified by way of example by these reference numerals.

The invention claimed is:

1. A reinforcing panel for construction of reinforced concrete structures, the reinforcing panel comprising:

a panel of insulating material;

a plurality of sticks provided with a corresponding pair of slots near ends of said plurality of sticks, said corresponding pair of slots being opposed and offset from one another in a longitudinal direction with respect to said plurality of sticks, said sticks being bent longitudinally so as to arrange said pairs of slots on orthogonal planes and said sticks being inserted to pass through said panel of insulating material so as to have respective slots protruding bilaterally on orthogonal planes;

a plurality of reinforcing metal wires connected to said slots of said sticks to form a network.

2. A panel according to claim 1, wherein said pairs of slots have a circular shape and said pairs of slots are open laterally at said sticks.

3. A panel according to claim 2, wherein said sticks have at least one opening formed in a middle position between said pair of slots configured for optimizing anchoring of said sticks to said panel of insulating material and reducing a weight of said sticks.

4. A panel according to claim 1, wherein said sticks have at least one opening formed in a middle position between said pair of slots configured for optimizing anchoring of said sticks to said panel of insulating material and reducing a weight of said sticks.

5. A panel according to claim 1, wherein said sticks have ends with rounded edges.

6. A method for producing reinforcing panels, the method comprising the steps of:

providing a plurality of sticks of predetermined size obtained from at least one strip of material;

making a corresponding pair of slots near ends of said sticks, said pair of slots being opposed and offset from one another in a longitudinal direction with respect to said sticks;

bending longitudinally said sticks so as to arrange said pair of slots on orthogonal planes;

providing a mold having a pair of opposed front walls connected by perimeter connection means;

associating said plurality of sticks with said pair of opposed front walls of said mold, wherein said sticks are arranged on orthogonal planes and respective slots protrude bilaterally from an inner compartment defined by said opposed front walls and said perimeter connection means of said mold;

introducing into said mold an insulating material to obtain a panel of insulating material;

connecting a series of reinforcing metal wires to said slots of said sticks so as to form a network.

7. A method according to claim 6, wherein, between introducing said insulating material into said mold and connecting said series of reinforcing metal wires to said slots of said sticks so as to form said network, the method comprising a further step of moving at least one of said opposed front walls of said mold to extract said panel of insulating material from said mold.

8. A method according to claim 7, wherein associating said plurality of sticks with said pair of opposed front walls of said mold, wherein said sticks are arranged on said orthogonal planes and said respective slots protrude bilaterally from said inner compartment defined by said opposed front walls and by said perimeter connection means of said mold comprises the further steps of:

feeding a plurality of said sticks on feeding devices configured for being provided at corresponding holes made on one of said front opposed walls, said feeding devices being provided with respective pusher members;

pushing said sticks individually through said corresponding holes of said one of said front walls by said respective pusher members and guiding said sticks using said feeding devices until said sticks are inserted into said corresponding holes made on said one of said opposed front walls.

9. A method according to claim 6, wherein associating said plurality of sticks with said pair of opposed front walls of said mold, wherein said sticks are arranged on said orthogonal planes and said respective slots protrude bilaterally from said inner compartment defined by said opposed front walls and by said perimeter connection means of said mold comprises the further steps of:

feeding a plurality of said sticks on feeding devices configured for being provided at corresponding holes made on one of said front opposed walls; said feeding devices being provided with respective pusher members;

pushing said sticks individually through said corresponding holes of said one of said front walls by said respective pusher members and guiding said sticks using said feeding devices until said sticks are inserted into said corresponding holes made on said one of said opposed front walls.

10. A method according to claim 9, wherein said step of pushing said sticks individually through said corresponding holes of said one of said front walls by said pusher members and guiding said sticks using said feeding devices until said sticks are inserted into said corresponding holes made on said one of said opposed front walls comprises the steps of:

extracting from said feeding devices respective guides until said feeding devices are abutted against said one of said opposed front walls;

actuating said pusher members to make said sticks slide individually on said guides until said sticks are inserted into said corresponding holes of said one of said opposed front walls.

11. A method according to claim 6, wherein said insulating material comprises foam.

12. A method for producing reinforcing panels, the method comprising the steps of:

providing a plurality of sticks of predetermined size obtained from at least one strip of material;

making a corresponding pair of slots near ends of said sticks, said corresponding pair of slots being opposed and offset from one another in a longitudinal direction with respect to said sticks;

bending longitudinally said sticks so as to arrange said pair of slots on orthogonal planes;

providing a mold having a pair of opposed front walls connected by perimeter connection means;

coating an inner compartment of said mold, defined by said opposed front walls and said perimeter connection means, with a shell;

introducing an insulating material into said mold to obtain a panel of insulating material;

associating said plurality of sticks with said pair of opposed front walls of said mold, wherein said sticks are arranged on orthogonal planes and respective slots protrude bilaterally with respect to said panel of insulating material;

connecting a series of reinforcing metal wires to said slots of said sticks so as to form a network.

13. A method according to claim 12, wherein, between associating said plurality of sticks with said pair of opposed front walls of said mold, wherein said sticks are arranged on orthogonal planes and said respective slots protrude bilaterally with respect to said panel of insulating material and connecting said series of reinforcing metal wires to said slots of said sticks so as to form said network, the method comprising a further step of moving at least one of said front opposed walls of said mold to extract said panel of insulating material from said mold.

14. A method according to claim 12, wherein said insulating material comprises foam.

* * * * *